US007059876B2

(12) United States Patent
Zhang et al.

(10) Patent No.: US 7,059,876 B2
(45) Date of Patent: Jun. 13, 2006

(54) ELECTRICAL CONNECTOR ASSEMBLY HAVING PICK-UP DEVICE

(75) Inventors: Chi Zhang, Kunsan (CN); Ya-Lei Xue, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/951,501

(22) Filed: Sep. 27, 2004

(65) Prior Publication Data

US 2005/0070129 A1 Mar. 31, 2005

(30) Foreign Application Priority Data

Sep. 26, 2003 (CN) ..... 03 2 52323

(51) Int. Cl.
*H01R 13/44* (2006.01)

(52) U.S. Cl. ..... 439/135; 439/940

(58) Field of Classification Search ..... 439/135, 439/940

See application file for complete search history.

(56) References Cited

U.S. PATENT DOCUMENTS 4,396,245 A 8/1983 Lane
5,096,428 A * 3/1992 Lwee et al. ..... 439/79
5,106,313 A * 4/1992 Lwee et al. ..... 439/135
5,249,977 A 10/1993 Tanaka et al.
5,507,657 A * 4/1996 Seto et al. ..... 439/135
5,609,500 A * 3/1997 Holmes et al. ..... 439/540.1
5,681,174 A 10/1997 Correl, Jr. et al.
5,688,133 A 11/1997 Ikesugi et al.
6,120,303 A * 9/2000 Tung ..... 439/41
6,164,990 A * 12/2000 Yu et al. ..... 439/135
6,174,171 B1 1/2001 Fu
6,210,225 B1 4/2001 Cai et al.
6,371,776 B1 4/2002 Li et al.
6,439,901 B1 8/2002 Ji et al.

* cited by examiner

*Primary Examiner*—Tho D. Ta
(74) *Attorney, Agent, or Firm*—Wei Te Chung

(57) ABSTRACT

An electrical connector assembly includes a right-angle connector (1) and a pick-up device (2) assembled to the connector (1) to provide a vacuum suction surface. The right-angle connector (1) includes a dielectric housing (10) with a mating portion (11), a mounting face (120), and a pair of locking portions (121). The pick-up device (2) is assembled to the connector (1) in a direction parallel to mounting face (120) and comprises a rectangular base (20) having a substantially planar upper surface (200) and an opposite lower surface (201), and a pair of retaining portions (21) depending down from the lower surface (201) and engaged with the locking portions (121) of the connector (1).

7 Claims, 8 Drawing Sheets

ELECTRICAL CONNECTOR ASSEMBLY HAVING PICK-UP DEVICE

BACKGROUND OF THE INVENTION

1. Field of the Invention

The present invention generally relates to an electrical connector assembly, and more particularly to an electrical connector assembly having a pick-up device assembled thereon to provide a vacuum suction pick-up surface.

2. Description of Related Art

Vacuum suction mechanisms are well known in the electronic assembly art and are used for retrieving electronic components, such as electrical connectors, from a supply source and transferring the component by applying negative air pressure to the components and placing the component on a printed circuit board (PCB) in a preselected position for soldering. Generally, the vacuum suction mechanism comprises a suction nozzle. An electrical connector is grasped by the suction nozzle and is robotically transferred to the position on the printed circuit board with great accuracy.

Most electrical connectors, however, are devoid of flat, solid surface suitable for being grasped by the suction nozzle. To overcome this problem, transfer or placement members having a flat, non-porous surface have been developed for attaching to connectors. Such connector placement members are described in the U.S. Pat. Nos. 5,688,133; 4,396,245; 5,249,977; 5,681,174; 6,174,171; and 6,439,901. These patents describe placement members designed for an electrical connector having two opposite sidewalls extending upward from a connector body. The placement members have a flat top surface suitable for being grasped by a vacuum suction nozzle and downwardly extending legs for engaging with the sidewalls of the connector body.

For example, FIGS. 6 and 7 show the placement cover of U.S. Pat. No. 5,688,133 (the '133 patent). The placement cover 8 is made of metallic material, formed by stamping. The placement cover 8 includes a cover plate 80 with a flat top surface and two pairs of resilient legs extend downwardly from each end of the cover plate 80. Each pair of legs has an outer engagement leg 81 and an inner engagement leg 82. The outer and inner legs 81, 82 are spaced apart from each other to define a receiving space 83. The dielectric housing 90 of the connector 9 has a pair of opposing longitudinal sidewalls 901 and a center wall (not labeled). A slot 902 is defined between the sidewalls 901 and the center wall. When the placement cover 8 is assembled on the connector 9, each space 83 receives a sidewall 901 of the dielectric housing 90 and the outer and inner legs 81, 82 abut against the outer and inner surfaces of the sidewalls 901. However, the placement cover 8 of the '133 patent is made of metal and the shape and dimension of the outer and inner engagement legs 81, 82 must be precisely formed so that they can be mated with the connector reliably and therefore, the manufacturing process is complicated and adds cost.

U.S. Pat. No. 6,439,901, which has the same assignee as the present invention, discloses a placement member made of a resilient dielectric material, as shown in FIG. 8. The placement member 7 is assembled on a connector 6 and has a pair of downwardly projecting legs 71 at each end thereof. A retaining foot 710 is formed at an end of each leg 71 for abutting against an inner surface of longitudinal sidewalls 61 of the connector 6. The manufacturing method of the placement member 7 is simpler than that of the placement cover 8. However, the placement member 7/8 has no positioning element and therefore, the placement member 7/8 may end up being positioned in any place along the longitudinal direction "N". As a result, the placement member 7/8 could not be assembled on true position of the electrical connector, and the precision and efficiency of the robotic assembly is reduced.

However, for right-angle electrical connector widely used in the electronic industry, whose mating face facing to a corresponding connector is perpendicular to a mounting face facing to a printed circuit board, the placement members above-mentioned are not applicable. Most right-angle electrical connectors include a dielectric housing with a flat top surface suitable for being grasped by the suction nozzle. However, the top surface of housing is commonly relatively small and not smooth enough. So if the top surface is used as the placement member, the connector can't be grasped firmly by the vacuum suction, and may wobble or fall off in the process of being transferred to a printed circuit board.

U.S. Pat. No. 6,210,225 (the '225 patent) discloses a right-angle electrical connector with a pick-up cover. The electrical connector comprises an elongate pick-up cover and an elongate insulative housing. An upper surface is disposed on the top of the insulative housing and defines several positioning holes and recesses, each recess further forming a corresponding tab therein. A pair of guiding arms extends rearwardly from a rear side of the insulative housing. The pick-up cover is made of a metal material and comprises a flat plate with an upper side and a lower side, a pair of latches extending downward from the lower side. Several positioning ridges are formed on a forward portion of the lower side and a positioning bar is formed on a rearward portion of the lower side between the latches. A clipping portion is formed at a distal end of the latches. In use, the flat plate of the pick-up cover is fitted to the upper surface of the housing, the clipping portion of the latches of the flat plate sliding from the rear of an outer side of the guiding aims toward the rear side of the housing, the positioning ridges on the lower side snappingly engaging with the positioning holes in the upper surface, the positioning bar engaging with upper inside edges of the guiding arms and the rear side of the housing. The conductive pick-up cover is thus retained on the housing firmly.

Obviously, the manufacture process of the conductive pick-up cover mentioned in the '225 patent is complex and accordingly increases cost of the manufacture. Furthermore, the engagement of the pick-up cover with the connector is so tedious that the efficiency of their engagement is low. Hence, an electrical connector assembly having an improved pick-up device is desired to overcome the above-mentioned disadvantages.

SUMMARY OF THE INVENTION

Accordingly, an object of the present invention is to provide an electrical connector assembly having an improved, low cost pick-up device reliably and precisely assembled on a right-angle electrical connector.

Another object of the present invention is to provide an electrical connector assembly having an improved pick-up device which can be assembled to and removed from a corresponding connector easily.

In order to achieve objects set forth, an electrical connector assembly in accordance with the present invention comprises an improved pick-up device assembled on a right-angle connector. The right-angle connector includes a dielectric housing with a mating portion facing to a complementary connector, a mounting face facing to a corresponding printed circuit board, and a pair of locking portion. The mating portion forms a mating face perpendicular to the mounting face. The pick-up device provides a vacuum suction surface for a vacuum placement mechanism to attach to. The pick-up device is made of a resilient insulative material and comprises a rectangular base having a substantially planar upper surface and an opposite lower surface, a pair of retaining portions depending from the lower surface, and a tab extending upwardly from a longitudinal edge of the upper surface of the base to facilitate the assembly of the pick-up device with the connector. The retaining legs are engaged with the locking portions of the connector firmly and reliably to insure the connector can be picked up firmly and transfer to a preslected position exactly on the printed circuit board.

Other objects, advantages and novel features of the invention will become more apparent from the following detailed description of the present embodiment when take in conjunction with the accompany drawings.

DETAILED DESCRIPTION OF PREFERRED EMBODIMENTS

Figure 1:
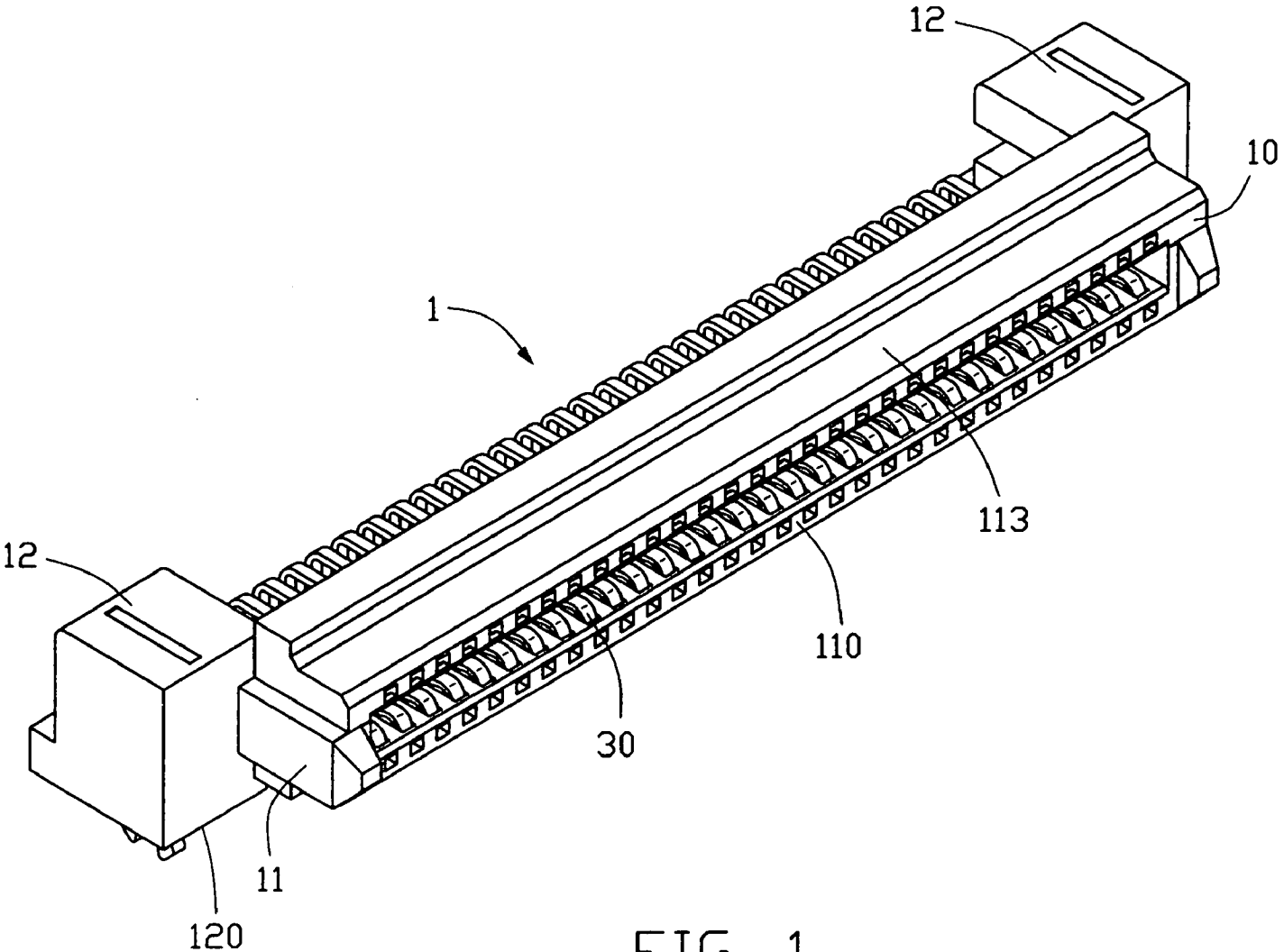
FIG. 1 is perspective view of a connector of an electrical connector assembly in accordance with the present invention.

Reference will now be made to the drawings to describe the present invention in detail.

Referring to FIGS. 1–4, a right-angle electrical connector 1 of an electrical connector assembly in accordance with the present invention is indicated. The electrical connector 1 includes a rectangular insulative housing 10, a plurality of contacts 30 and a spacer 40 for positioning the contacts 30. The housing 10 extends along a longitudinal direction M and includes a mating portion 11 extending forwardly in a horizontal direction perpendicular to the longitudinal direction M, facing to a complementary electrical connector (not shown), and a pair of arms 12 extending rearwardly from opposite ends of the mating portion 11 and defining a receiving space 13 therebetween for receiving the contacts 30. The mating portion 11 has a flat top face 113 parallel to the horizontal direction, a mating face 110 perpendicular to the top face 113, and a central slot 111 defined in the mating face 110 which is intended to receive the mating electrical connector therein, and two rows of passageways 112 arranged at regular intervals therethrough. The pair of arms 12 comprises a mounting face 120 perpendicular to the mating face 110 of the mating portion 11 for being mounted on a face of an electrical apparatus, such as a top surface of a printed circuit board, a rear face 124 parallel to the mating face 110, and a pair of locking portions 121. In the present embodiment, each of the locking portions 121 includes a guiding recess 122 defined in an inner surface of the arm 12 and passing through the rear face 124, and a rib 123 lying atop the recess 122. The recess 122 and the rib 123 both are parallel to the mounting face 120 of the arm 12. Each contacts 30 is received in a corresponding passageway 112 and includes a contacting portion 31 exposed to the central slot 111, a connecting portion 32 extending rearwardly from the contacting portion 31 and into the receiving space 13, and a tail portion 33, perpendicular to the contacting portion and the connecting portion, extending downwardly from the connecting portion beyond the mounting face 120 for mechanically and electrically connecting the connector 1 with a printed circuit board (PCB). The spacer 40 is retained in the receiving space 13 between the pair of arms 12 as illustrated, engaging with the arms 12 firmly and reliably, and defines a plurality of through holes (not labeled) for positioning the contacts in their proper position to secure the mechanical and electrical connection of the connector 1 with the PCB.

Referring to FIGS. 2–5, a pick-up device 2 of an electrical connector assembly in accordance with the present invention is illustrated. This connector pick-up device 2 is used to provide a substantially planar, or flat, surface to the connector 1 when attached thereto. The pick-up device 2 is made of a resilient insulative material and comprises a rectangular plate 20. The plate 20 forms a flat upper surface 200 and an opposite lower surface 201. The flat upper surface 200 is engaged by a transfer or placement mechanism in which typically has an internal port communicating with a source of negative air pressure. The negative air pressure creates a vacuum at the transfer arm port which results the transfer arm to attach it to the connector placement member by suction, as is known in the art. Once attached, the connector 1 may be transferred from a supply source (not shown) to another electronic assembly component, typically a circuit board. The connector pick-up device 2 remains in place upon the connector 1 until it is joined to the circuit board (not shown).

Figure 4:
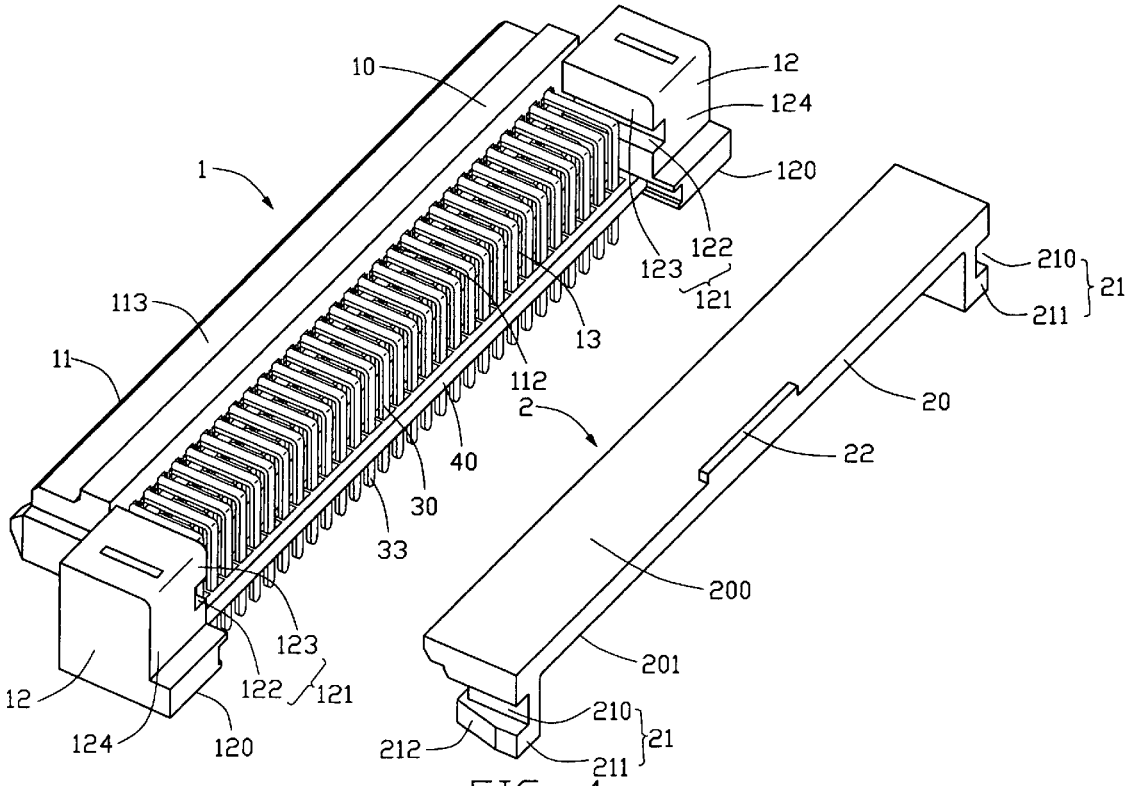
FIG. 4 is an exploded, perspective view of the electrical connector assembly shown in FIG. 3.
Figure 5:
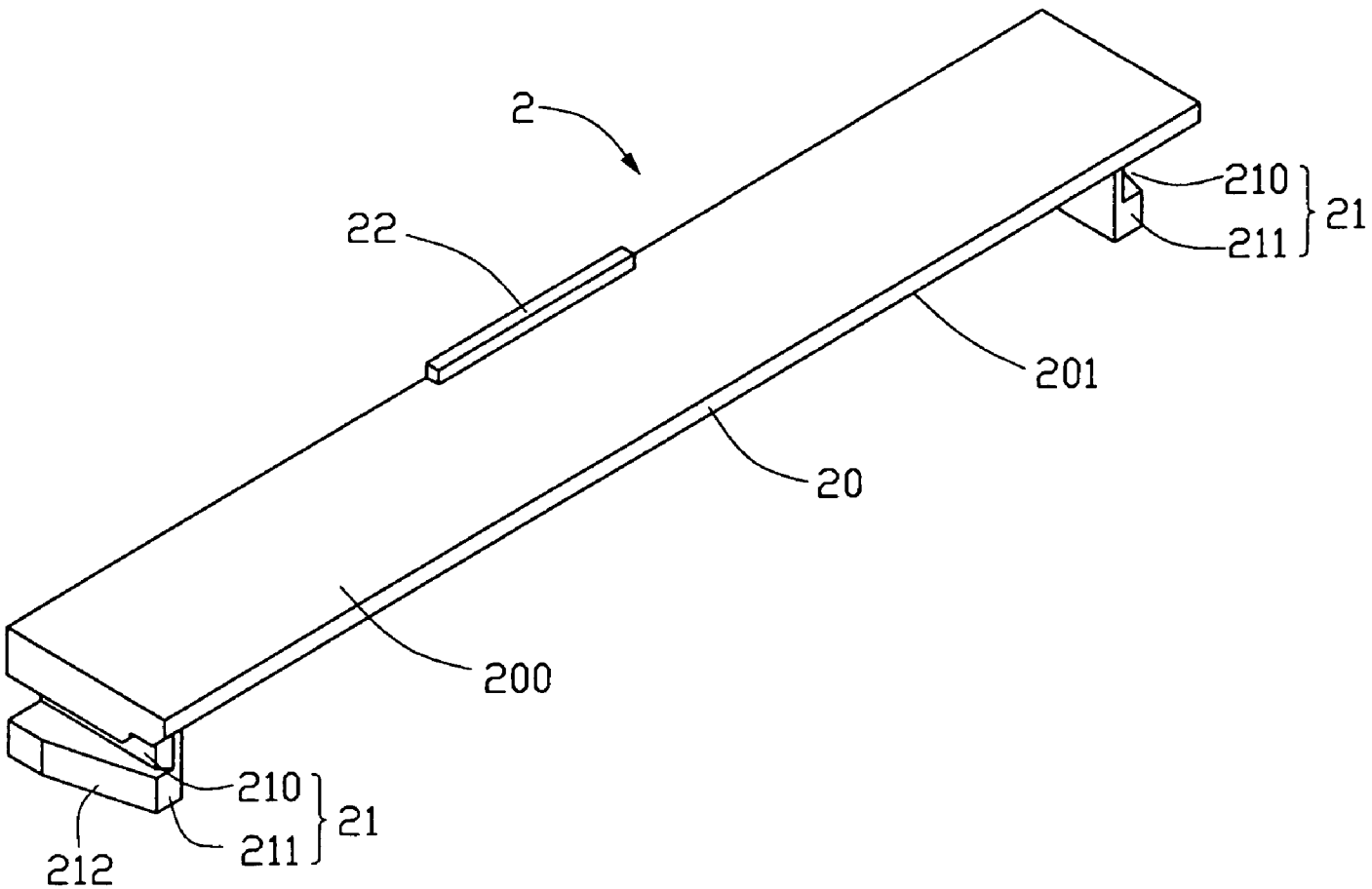
FIG. 5 is a perspective view of a pick-up device of the electrical connector assembly in accordance with the present invention.
Figure 6:
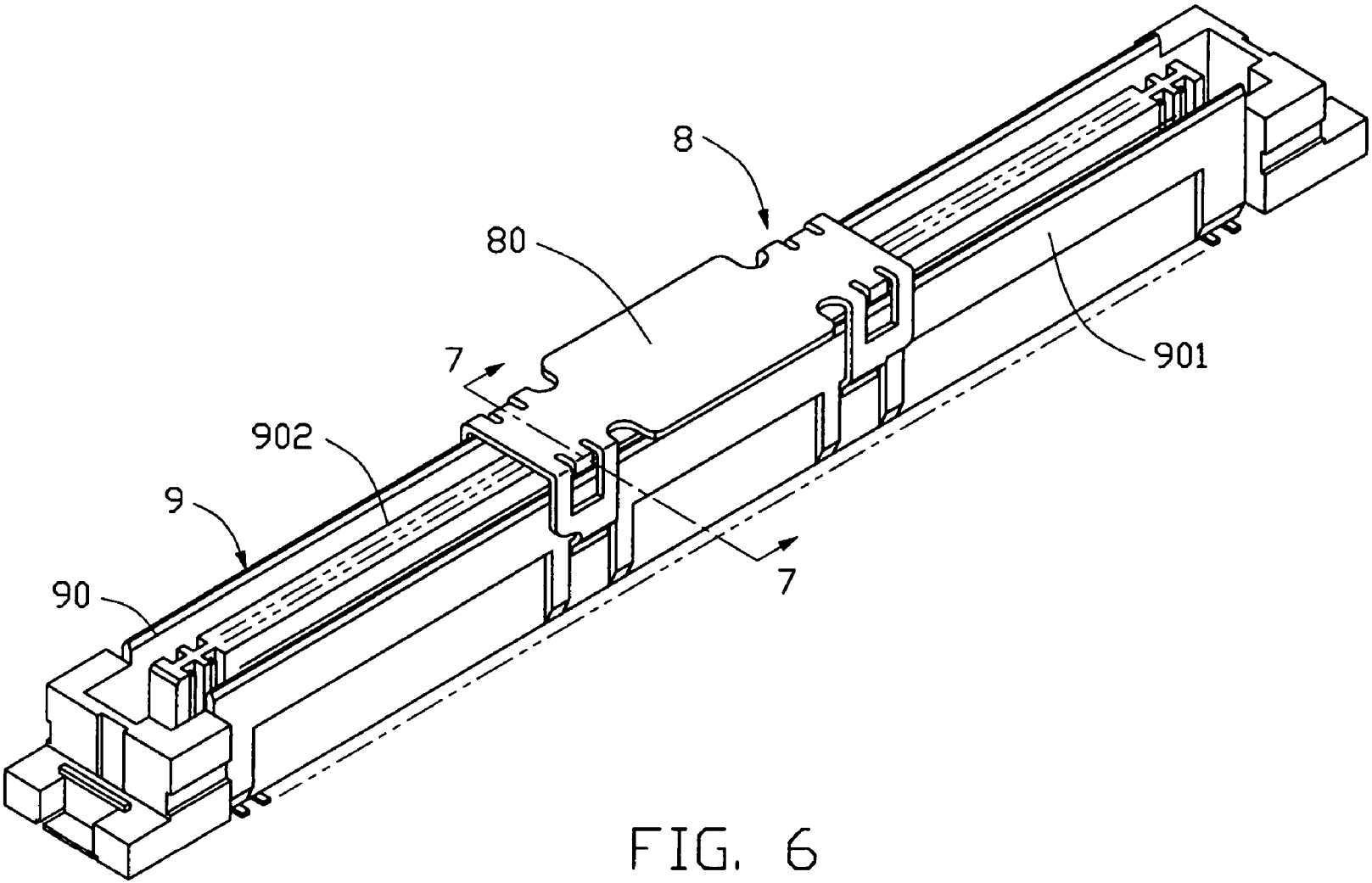
FIG. 6 (PRIOR ART)
FIG. 6 is a perspective view of a conventional connector assembly with a placement member.
Figure 7:
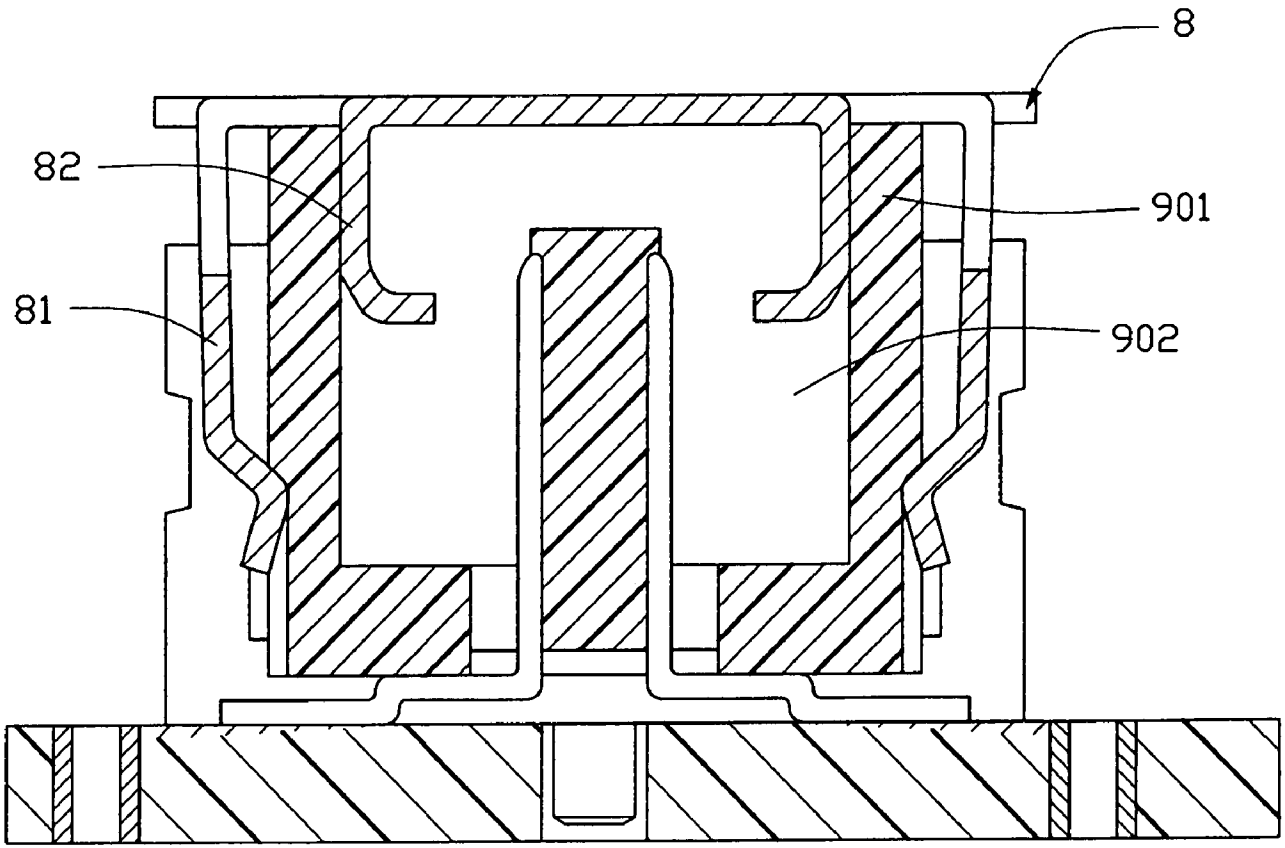
FIG. 7 (PRIOR ART)
FIG. 7 is a cross-sectional view of the electrical connector assembly taken along line 7—7 of FIG. 6.
Figure 8:
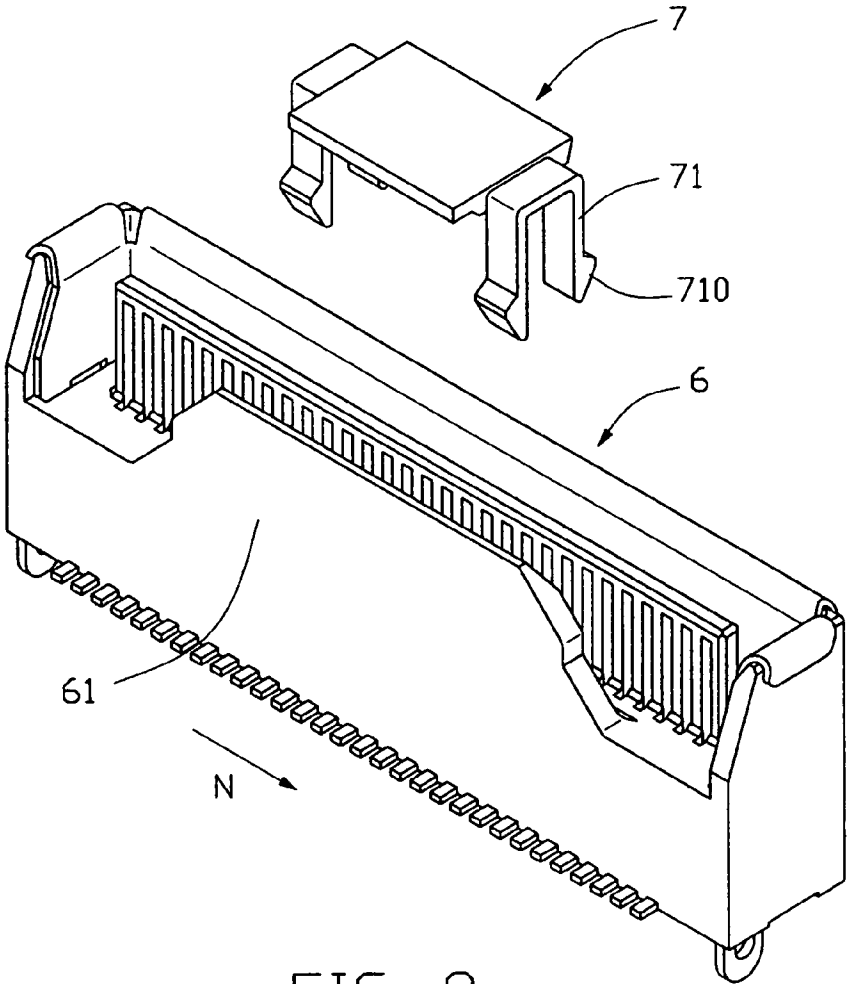
FIG. 8 (PRIOR ART)
FIG. 8 is a perspective view of another conventional connector assembly with a placement member.

Tuning to FIGS. 4 and 5, the pick-up device 2 comprises a pair of retaining portions 21 depending down from the lower surface 201, and a tab 22 extending upwardly from a longitudinal edge of the upper surface 200 of the plate 20 to facilitate the assembly of the pick-up device 2 with the connector 1, and increasing the assembly efficiency. The retaining portions 21 are joined to the ends of the plate 20. Each retaining portion 21 includes a gripping foot 211 and a guiding channel 210 between the gripping foot 211 and the plate 20. The gripping foot 211 is formed with an inclined guiding section 212 on its ends facing to the connector to facilitate the engagement of the pick-up device 2 to the connector 1. Certainly, in other embodiments guiding sections also can be defined in the channels 210.

Figure 2:
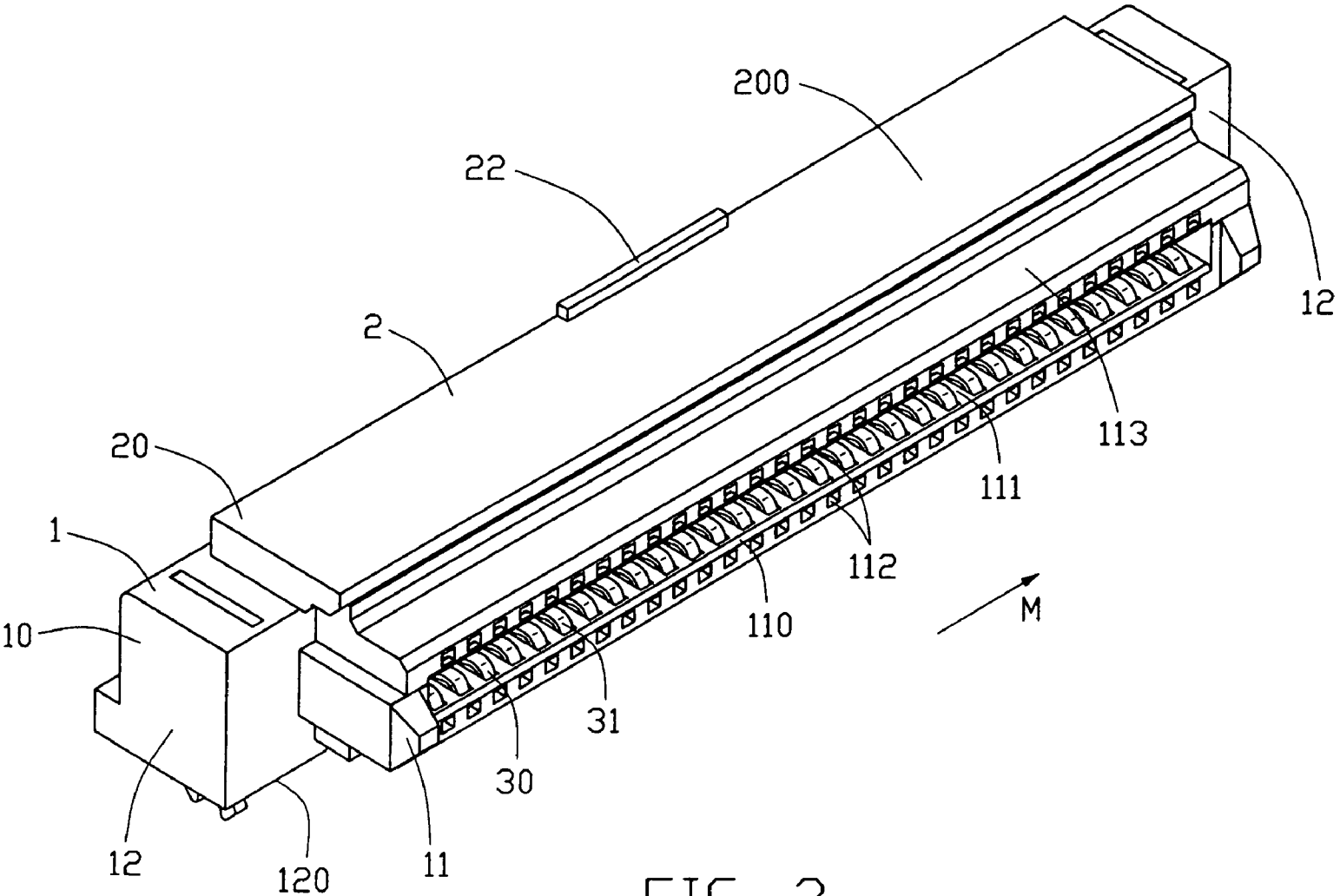
FIG. 2 is an assembled perspective view of the electrical connector assembly in accordance with the present invention.
Figure 3:
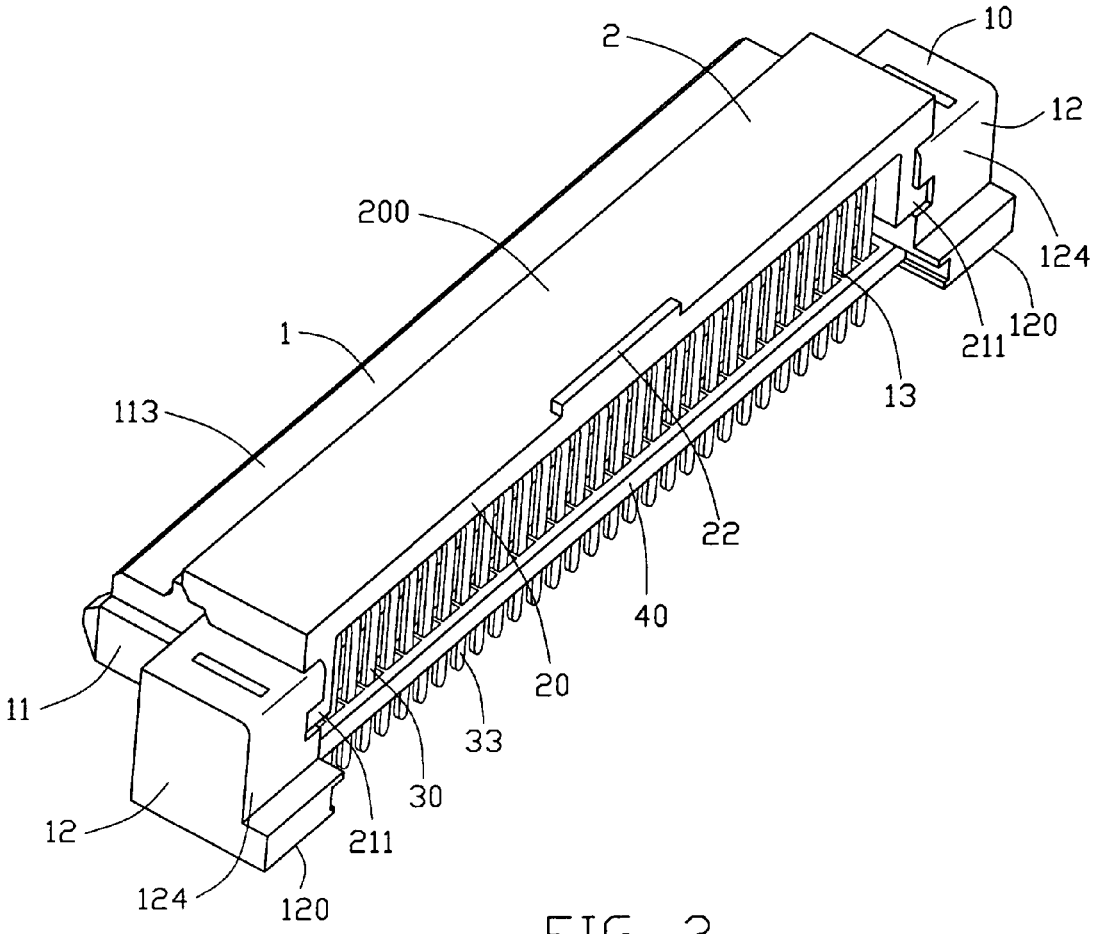
FIG. 3 is a view similar to the FIG. 2, but taken from rear aspect.

Referring to FIGS. 2 and 3, in assembly, the pick-up device 2 is assembled to the connector 1 from the rear face 124 of the connector 1 and along a direction parallel to the mounting face 120 of the connector 1. The plate 20 of the pick-up device 2 lies atop the receiving space 13 coving the tail portions 33 positioned between arms 12 of the housing 1 in a vertical direction perpendicular to the horizontal direction and the longitudinal direction M. And after assembled to the housing 1, the plate 20 of the pick-up device 2 is parallel to the mounting face 120 of the connector 1. The tab 22 of the pick-up device 2 is located away from the mating portion 11 of the connector 1. The gripping foot 211 is retained in the recess 122 of the connector 1, and the rib 123 of the connector 1 is received in the channel 210. With the above arrangements, the pick-up device 2 is assembled on the electrical connector 1 reliably and precisely, and the electrical connector 1 can be grasped reliably by a vacuum suction nozzle and be transferred firmly to a preselected position on the printed circuit board without wobbling or deflecting. Furthermore, the tab 2 not only facilitates assembly of the pick-up device 2 to the connector 1 but also its remove therefrom. The manufacture process is much simpler and the cost is lower than those of prior arts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for being mounted on a printed circuit board by a vacuum suction nozzle, comprising:

a connector comprising:

a dielectric housing having a mating portion, and a pair of arms extending rearwardly from opposite ends of the mating portion and defining a receiving space therebetween, the mating portion formed with a mating face facing to a complementary connector, the pair of arms comprising a mounting face facing to a corresponding printed circuit board, a rear face, and a pair of locking portions, the mating face perpendicular to the mounting face and parallel to the rear face; and a plurality of conductive contacts received in the mating portion and the receiving space; and a pick-up device made of a resilient insulative material and assembled to the connector from the rear face of the connector along a direction parallel to the mounting face and lying atop the receiving space of the connector, comprising:

a rectangular base having a substantially planar, smooth upper surface adapted to be grasped by the suction nozzle, an opposite lower surface;

a pair of retaining portions depending down from the lower surface releasably engaged with the pair of arms of the connector; and a tab protruding upwardly from a longitudinal edge of the upper surface of the base.

2. The electrical connector assembly as described in claim 1, wherein each of the locking portions comprises a guiding recess defined in an inner surface of the arm and crossing through the rear face of the connector, and a rib lying atop the recess, and wherein each retaining portion of the pick-up device comprises a gripping foot received in the recess of the connector, and a guiding channel between the gripping foot and the base to receive the rib of the connector.

3. The electrical connector assembly as described in claim 2, wherein the gripping foot of each retaining portion of the pick-up device comprises an inclined guiding section on its ends facing to the connector.

4. The electrical connector assembly as described in claim 2, wherein guiding sections are formed in the guiding recesses of the connector.

5. An electrical connector comprising:

an insulative housing defining a horizontal direction, a mounting face parallel to the horizontal direction, a mating portion forming a mating face perpendicular to the horizontal direction, a central slot defined in the mating portion;

a horizontal channel defined in the housing;

a plurality of contacts received in the housing;

a pick-up device defining a flat surface and a remaining portion, said pick-up device being assembled to the housing from rear toward the housing along said horizontal direction with the remaining portion of the pick-up device engaged with said horizontal channel of the housing.

6. The electrical connector as described in claim 5, wherein the housing of the electrical connector further comprises a pair of arms extending rearward at two opposite ends of the mating portion with the horizontal channel defined in the pair of arms respectively.

7. The electrical connector as described in claim 6 wherein each of the contacts comprises a contacting portion exposed into the central slot of the mating portion, a tail portion right angled from the contacting portion and positioned between said pair of arms of the housing, coved by the pick-up device.

* * * * *